US010323402B1

(12) United States Patent
Yin et al.

(10) Patent No.: US 10,323,402 B1
(45) Date of Patent: Jun. 18, 2019

(54) BEAM-COLUMN CONNECTION STRUCTURE

(71) Applicant: RUENTEX ENGINEERING & CONSTRUCTION CO., LTD., Taipei (TW)

(72) Inventors: Samuel Yin, Taipei (TW); Jui-Chen Wang, Taipei (TW)

(73) Assignee: RUENTEX ENGINEERING & CONSTRUCTON CO., LTD., Taipei (TW)

( * ) Notice: Subject to any disclaimer, the term of this patent is extended or adjusted under 35 U.S.C. 154(b) by 0 days.

(21) Appl. No.: 16/139,563

(22) Filed: Sep. 24, 2018

(30) Foreign Application Priority Data

Mar. 26, 2018 (TW) ..... 107203868 U

(51) Int. Cl.

| | |
|---|---|
| ***E04B 1/04*** | (2006.01) |
| ***E04B 1/14*** | (2006.01) |
| ***E04B 1/16*** | (2006.01) |
| ***E04B 1/30*** | (2006.01) |
| ***E04B 1/24*** | (2006.01) |

(52) U.S. Cl.
CPC ..... *E04B 1/043* (2013.01); *E04B 1/14* (2013.01); *E04B 1/165* (2013.01); *E04B 1/2403* (2013.01); *E04B 1/30* (2013.01); *E04B 2001/2415* (2013.01); *E04B 2001/2457* (2013.01); *E04B 2001/2469* (2013.01)

(58) Field of Classification Search
CPC . E04B 1/043; E04B 1/165; E04B 1/14; E04B 1/30; E04B 1/2403; E04B 2001/2457
USPC ..... 52/250, 251, 253, 258, 259, 260, 649.3, 52/649.4, 651.4
See application file for complete search history.

(56) References Cited

U.S. PATENT DOCUMENTS

| | | | | | |
|---|---|---|---|---|---|
| 2,074,320 | A * | 3/1937 | Bauer | E04B 1/185 | 52/649.6 |
| 3,355,852 | A * | 12/1967 | Lally | E04B 1/943 | 52/202 |
| 3,593,477 | A * | 7/1971 | Briggs | E04B 1/185 | 52/253 |
| 3,938,294 | A * | 2/1976 | Gaburri | E04B 1/30 | 52/742.14 |
| 4,631,892 | A * | 12/1986 | Beck | E04C 3/34 | 405/239 |
| 4,864,797 | A * | 9/1989 | Sato | E02D 5/30 | 52/834 |
| 5,174,080 | A * | 12/1992 | Yoshimura | E04B 1/215 | 52/252 |
| 5,218,802 | A * | 6/1993 | Yoshimura | E04B 1/215 | 52/253 |
| 6,061,992 | A * | 5/2000 | Vincent | E04C 3/34 | 52/841 |

(Continued)

*Primary Examiner* — Brian E Glessner
*Assistant Examiner* — Adam G Barlow
(74) *Attorney, Agent, or Firm* — Juan Carlos A. Marquez; Marquez IP Law Office, PLLC

(57) ABSTRACT

The subject disclosure is related to a beam-column connection structure, comprising a first H-shaped steel beam, a second H-shaped steel beam generally perpendicularly connected to a side of the first H-shaped steel beam, and a third H-shaped steel beam generally perpendicularly connected to another side of the first H-shaped steel beam wherein a main stirrup penetrates these H-shaped steel beams and surrounds the joints thereof.

16 Claims, 14 Drawing Sheets

(56) References Cited

U.S. PATENT DOCUMENTS

| | | | | |
|---|---|---|---|---|
| 6,293,071 | B1 * | 9/2001 | Konstantinidis | E04C 5/02 52/659 |
| 7,647,742 | B2 * | 1/2010 | Han | E04B 1/24 52/236.5 |
| 8,549,805 | B2 * | 10/2013 | Kim | E04C 5/0645 52/253 |
| 8,863,445 | B2 * | 10/2014 | Zhong | E04B 1/165 52/79.14 |
| 2004/0231278 | A1 * | 11/2004 | Yin | E04C 5/0609 52/649.4 |
| 2010/0031605 | A1 * | 2/2010 | Hong | E04B 1/30 52/839 |
| 2010/0058700 | A1 * | 3/2010 | LeBlang | E04B 1/165 52/506.05 |
| 2010/0071315 | A1 * | 3/2010 | Hong | E04B 1/215 52/848 |
| 2012/0047835 | A1 * | 3/2012 | Zhong | E04B 1/165 52/364 |
| 2016/0298333 | A1 * | 10/2016 | Hsieh | E04B 5/40 |
| 2019/0078316 | A1 * | 3/2019 | Yin | E04B 1/30 |

* cited by examiner

BEAM-COLUMN CONNECTION STRUCTURE

FIELD OF THE INVENTION

The instant disclosure relates to a beam-column connection structure, in particular to a beam-column connection structure of a prefabricated steel-concrete composite column and a steel beam.

BACKGROUND

Conventional methods of constructing reinforced concrete (RC) buildings are conducted floor-by-floor from bottom to top, which is time consuming. Such conventional method involves many processes, such as tying the reinforced steels, molding, grouting and so on, which requires a great number of workers on the construction site. Thus, the quality of construction is highly dependent on factors such as weather and the skill and experience of the workers, and is difficult to control.

Using steel reinforced concrete (SRC) for load-bearing beams and columns may expedite the construction process. However, extensive use of SRC will require a great amount of steel, resulting in high construction costs.

To resolve the above problems, a composite construction including precast RC columns and steel beams is provided. For example, precast RC columns are first fabricated in the factory, and then transported to the construction site to be hoisted and assembled with steel beams. However, such conventional beam-column connection structure provides insufficient strength and vibration resistance, and thus would benefit from improvement.

Given the above, it is desired to provide a beam-column connection structure with greater structural strength and to provide a construction method that can rapidly assemble a precast RC column and steel beams.

SUMMARY OF THE INVENTION

The instant disclosure relates to a beam-column connection structure having high strength for bearing weight and good resistance to vibration.

According to one exemplary embodiment of the instant disclosure, a beam-column connection structure is provided which comprises: a first H-shaped steel beam, a second H-shaped steel beam, a third H-shaped steel beam and a main spiral stirrup. The first H-shaped steel beam comprises a top flange, a bottom flange which is substantially parallel to the top flange and a web plate substantially perpendicularly connected to the top flange and the bottom flange. The second H-shaped steel beam comprises a top flange, a bottom flange which is substantially parallel to the top flange and a web plate substantially perpendicularly connected to the top flange and the bottom flange. The first end of the second H-shaped steel beam is substantially perpendicularly connected to a side of the first H-shaped steel beam. The third H-shaped steel beam comprises a top flange, a bottom flange which is substantially parallel to the top flange and a web plate substantially perpendicularly connected to the top flange and the bottom flange. The first end of the third H-shaped steel beam is substantially perpendicularly connected to the other side of the first H-shaped steel beam, and the third H-shaped steel beam substantially aligns with the second H-shaped steel beam. The web plate of the first H-shaped steel beam has a plurality of first through holes therein disposed along a direction perpendicular to a lengthwise direction of the first H-shaped steel beam. The web plate of the second H-shaped steel beam has a plurality of second through holes therein disposed along a direction perpendicular to a lengthwise direction of the second H-shaped steel beam. The web plate of the first H-shaped steel beam has a plurality of third through holes therein disposed along a direction perpendicular to the lengthwise direction of the first H-shaped steel beam. The third through holes are disposed opposite to the first through holes in relation to the second and third H-shaped steel beams. The web plate of the third H-shaped steel beam has a plurality of fourth through holes therein disposed along a direction perpendicular to a lengthwise direction of the third H-shaped steel beam. The main spiral stirrup is penetrated through the first, second, third and fourth through holes and is connected with the first, second and third H-shaped steel beams.

According to another exemplary embodiment of the instant disclosure, a beam-column connection structure is provided which comprises: a first metal plate, a second metal plate, a first end plate, a second end plate, a third end plate, a fourth end plate and a main spiral stirrup. The first metal plate is substantially cross-shaped and has a first section, a second section, a third section, a fourth section and a first hole disposed between these sections. The second metal plate is substantially cross-shaped and has a first section, a second section, a third section, a fourth section and a second hole disposed between these sections. The second metal plate is substantially parallel to the first metal plate and is spaced apart from the first metal plate. The first end plate is connected to the first section of the first metal plate and the first section of the second metal plate. The second end plate is connected to the second section of the first metal plate and the second section of the second metal plate. The third end plate is connected to the third section of the first metal plate and the third section of the second metal plate. The fourth end plate is connected to the fourth section of the first metal plate and the fourth section of the second metal plate. The main spiral stirrup is disposed within a space between the first and second metal plates.

For further understanding of the instant disclosure, the following embodiments are provided along with illustrations to facilitate appreciation of the instant disclosure; however, the appended drawings are merely provided for reference and illustration and are not intended to be used for limiting the scope of the instant disclosure.

BRIEF DESCRIPTION OF THE DRAWINGS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

DETAILED DESCRIPTION OF THE PREFERRED EMBODIMENTS

Figure 1:
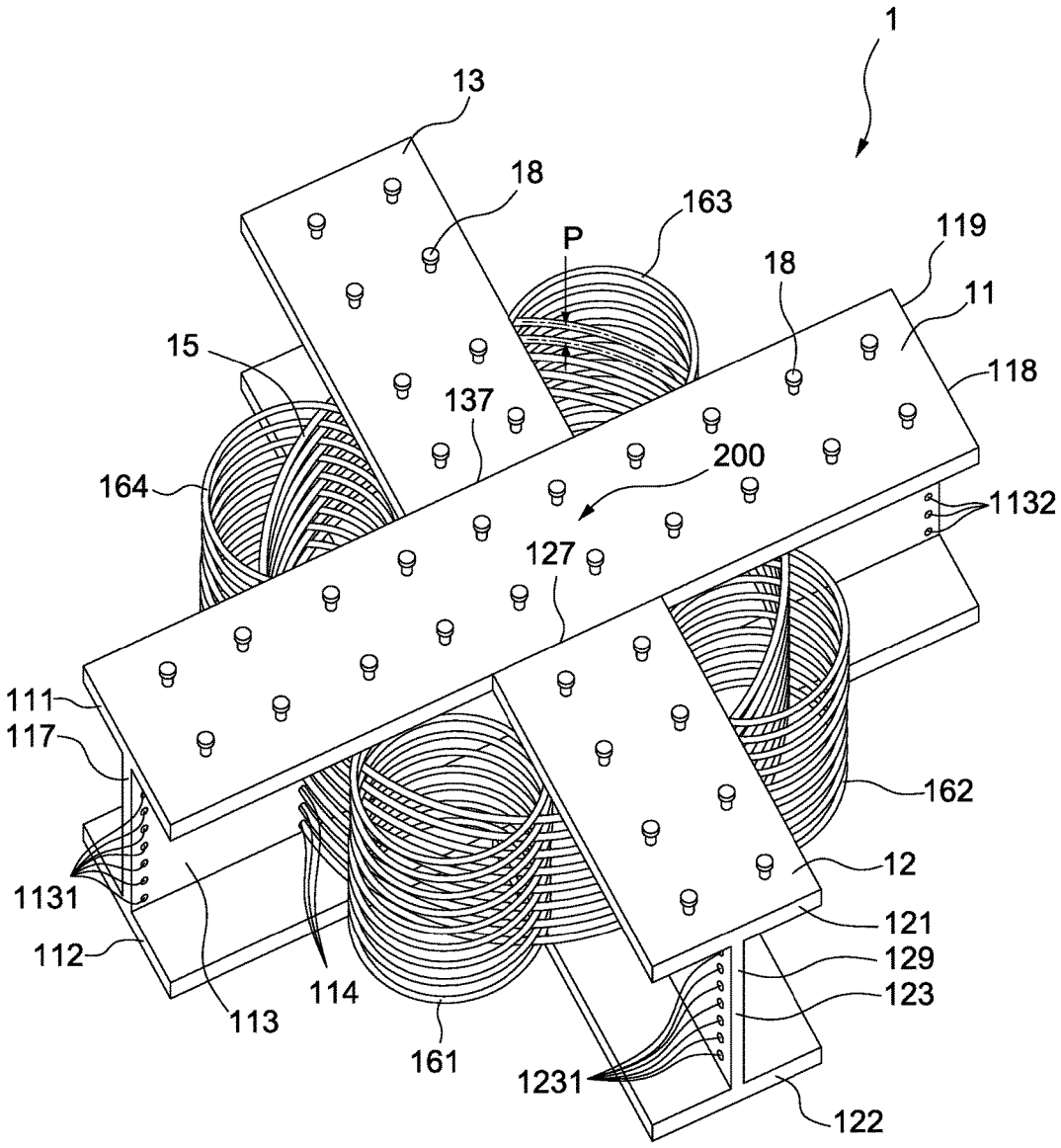
FIG. 1 is a perspective schematic view showing a beam-column connection structure in accordance with an embodiment of the instant disclosure.
Figure 2:
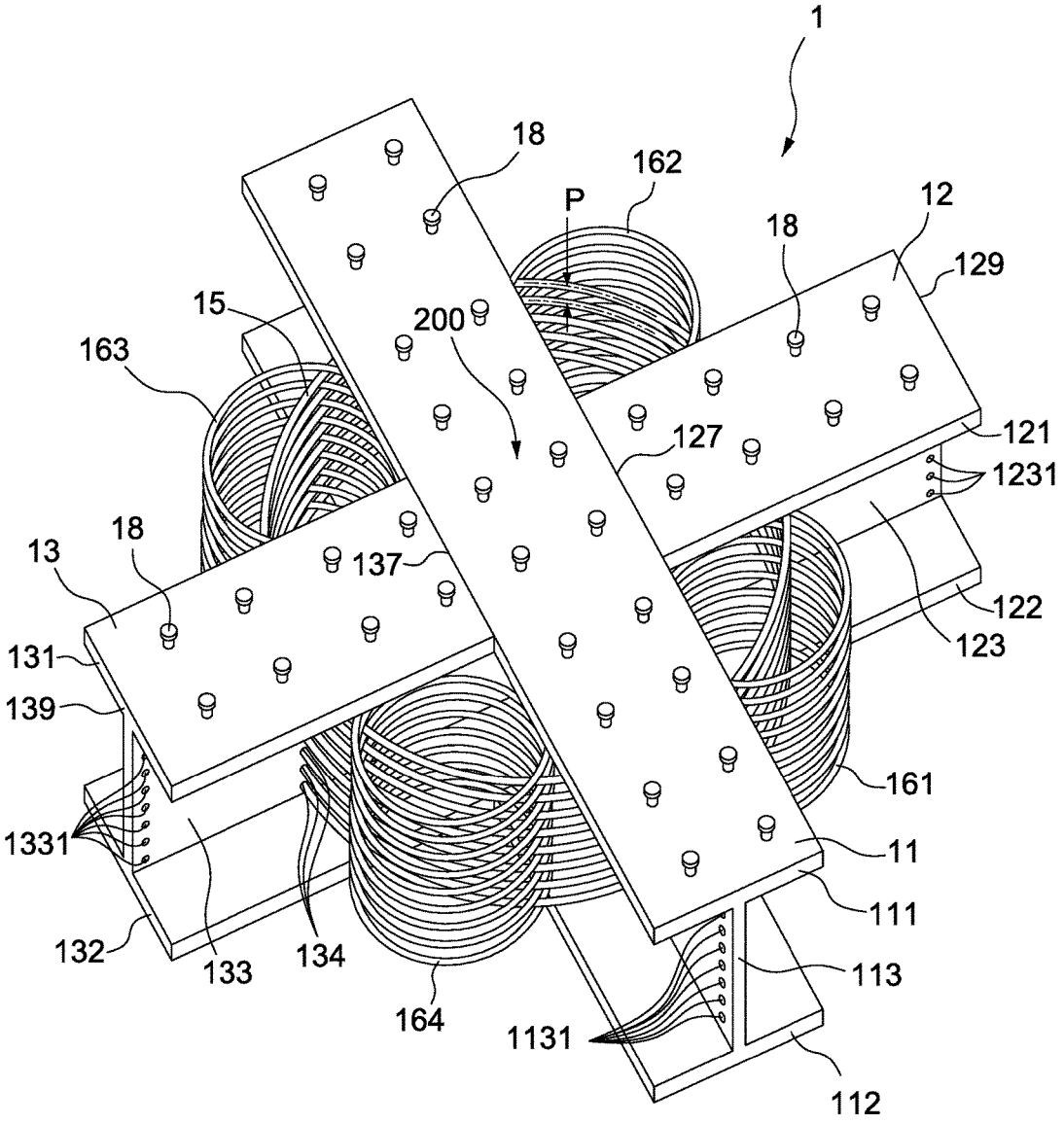
FIG. 2 is another perspective schematic view showing a beam-column connection structure in accordance with the embodiment of the instant disclosure.
Figure 3:
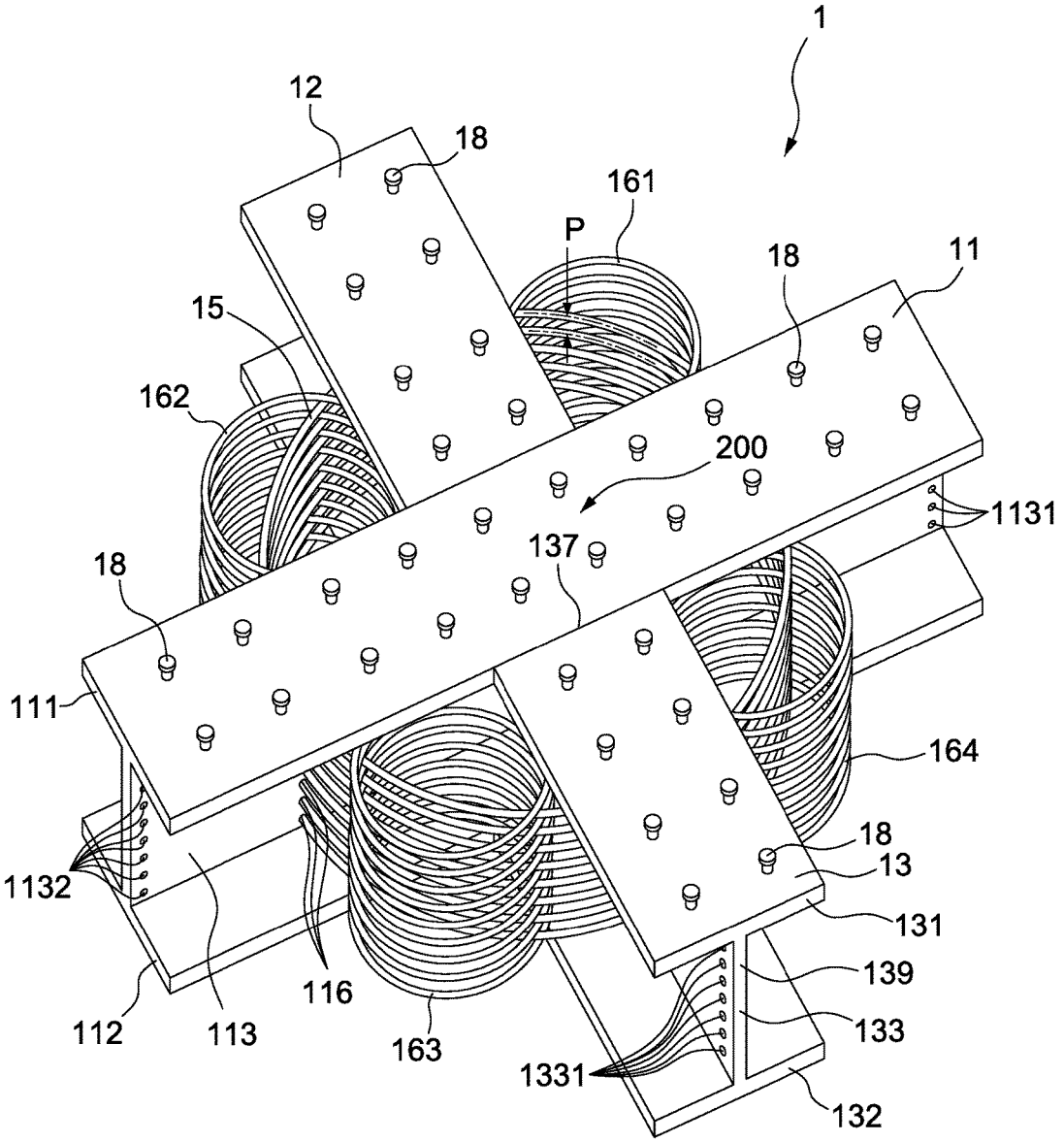
FIG. 3 is another perspective schematic view showing a beam-column connection structure in accordance with the embodiment of the instant disclosure.
Figure 4:
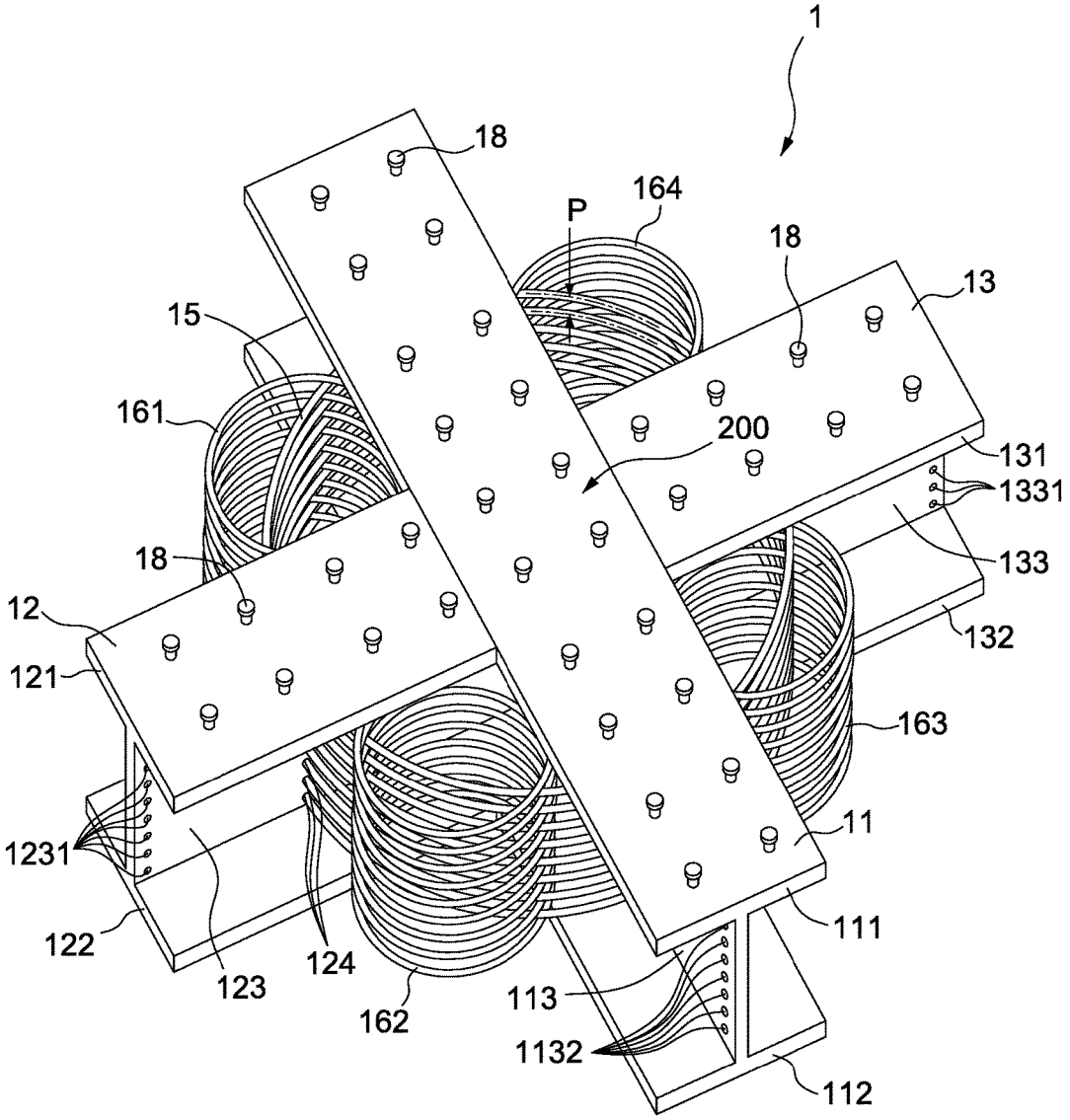
FIG. 4 is another perspective schematic view showing a beam-column connection structure in accordance with the embodiment of the instant disclosure.

FIGS. 1, 2, 3 and 4 are four perspective schematic views showing a beam-column connection structure in accordance with an embodiment of the instant disclosure. The beam-column connection 1 shown in FIG. 2 is the beam-column connection 1 shown in FIG. 1 rotated counterclockwise by an angle of 90°. The beam-column connection 1 shown in FIG. 3 is the beam-column connection 1 shown in FIG. 2 rotated counterclockwise by an angle of 90°. The beam-column connection 1 shown in FIG. 4 is the beam-column connection 1 shown in FIG. 3 rotated counterclockwise by an angle of 90°. The features and details of the beam-column 1 could be clearly shown by referring to FIGS. 1, 2, 3 and 4.

As shown in FIG. 1, the beam-column connection 1 comprises a first H-shaped steel beam 11 having a top flange 111, a bottom flange 112 which is substantially parallel to the top flange 111 and a web plate 113 substantially perpendicularly connected to the top flange 111 and the bottom flange 112. The first H-shaped steel beam 111 comprises a plurality first connecting holes 1131 and a plurality of second connecting holes 1132, wherein the plurality of the first connecting holes 1131 are disposed on the web plate 113 and adjacent to a first end 117 of the first H-shaped steel beam 11 and the plurality of second connecting holes 1132 are disposed at the web plate 113 and adjacent to a second end 119 of the first H-shaped steel beam 11, which is opposite to the first end 117 of the first H-shaped steel beam 11.

Further, referring to FIG. 1, the beam-column connection 1 further comprises a second H-shaped steel beam 12 having a top flange 121, a bottom flange 122 which is substantially parallel to the top flange 121 and a web plate 123 substantially perpendicularly connected to the top flange 121 and the bottom flange 122. A first end 127 of the second H-shaped steel beam 12 is connected to a side of the first H-shaped steel beam 11 such that the second H-shaped steel beam 12 is substantially perpendicular to the first H-shaped steel beam 11. Moreover, the second H-shaped steel beam 12 comprises a plurality of third connecting holes 1231 disposed on the web plate 123 and adjacent to a second end 129 of the second H-shaped steel beam 12, which is opposite to the first end 127 of the second H-shaped steel beam 12.

Referring to FIG. 3, the beam-column connection 1 further comprises a third H-shaped steel beam 13 having a top flange 131, a bottom flange 132 which is substantially parallel to the top flange 131 and a web plate 133 substantially perpendicularly connected to the top flange 131 and the bottom flange 132. The first end 137 of the third H-shaped steel beam 13 is connected to another side of the first H-shaped steel beam 11 such that the third H-shaped steel beam 13 is substantially perpendicular to the first H-shaped steel beam 11. Further, the third H-shaped steel beam 13 substantially aligns with the first H-shaped steel beam 12. Moreover, the third H-shaped steel beam 13 comprises a plurality of fourth connecting holes 1331 disposed on the web plate 133 and adjacent to a second end 139 of the third H-shaped steel beam 13, which is opposite to the first end 137 of the third H-shaped steel beam 13.

The length of the second H-shaped steel beam 12 is substantially equal to the length of the third H-shaped steel beam 13. In particular, the distance between the first end 117 of the first H-shaped steel beam 11 and the joint 200 of the first H-shaped steel beam 11, the second H-shaped steel beam 12 and the third shaped steel 13 is substantially equal to the distance between the second end 119 of the first H-shaped steel beam 11 and the joint 200. Further, such distances are substantially equal to the length of the second H-shaped beam 12 or the length of the third H-shaped beam 13.

In addition, a plurality of shear studs are disposed at the top flange 111 of the first H-shaped steel beam 11, the top flange 121 of the second H-shaped steel beam 12 and the top flange 131 of the third H-shaped steel beam 13.

The first H-shaped beam 11, the second H-shaped beam 12 and the third H-shaped beam of the beam-column connection 1 further comprise a plurality of first through holes 114, a plurality second through holes 124, a plurality of third through holes 116 and a plurality of fourth through holes 134. The first through holes 114 are disposed on the web plate 113 of the first H-shaped steel beam 11 and aligned along a direction which is substantially perpendicular to the lengthwise direction of the first H-shaped steel beam 11 (see FIG. 1). The second through holes 124 are disposed on the web plate 123 of the second H-shaped steel beam 12 and aligned along a direction which is substantially perpendicular to the lengthwise direction of the second H-shaped steel beam 12 (see FIG. 4). The third through holes 116 are disposed on the web plate 113 of the first H-shaped steel beam 11 and aligned along a direction which is substantially perpendicular to the lengthwise direction of the first H-shaped steel beam 11, wherein the third through holes 116 are disposed opposite to the first through holes 114 in relation to the second H-shaped steel beam 12 and the third H-shaped steel beam 13 (see FIG. 3). The fourth through holes 134 are disposed on the web plate 133 of the third H-shaped steel beam 13 and aligned along a direction which is substantially perpendicular to the lengthwise direction of the third H-shaped steel beam 13.

The distance between the first through holes 114 and the joint 200, the distance between the second through holes 124 and the joint 200, the distance between the third through holes 116 and the joint 200 and the distance between the fourth through holes 134 and the joint 200 are substantially the same.

As shown in FIGS. 1, 2, 3 and 4, the main spiral stirrup 15 is penetrated through the first, second, third and fourth through holes 114, 124, 116, 134 and is connected with the first, second and third H-shaped steel beams 11, 12, 13. The main spiral stirrup 15 has a uniform pitch P. Further, the distance between two adjacent first through holes 114, the distance between two adjacent second through holes 124, the distance between two adjacent third through holes 116 and the distance between two adjacent fourth through holes 134 are substantially equal to the pitch P of the main spiral stirrup 15.

Moreover, the beam-column connection 1 further comprises a first auxiliary spiral stirrup 161, a second auxiliary spiral stirrup 162, a third auxiliary spiral stirrup 163 and a fourth auxiliary spiral stirrup 164, and each of them partially intersects the main spiral stirrup 15. The first auxiliary spiral stirrup 161 penetrates, overlaps and intersects the portion of the main spiral stirrup 15 located between the first through holes 114 and the second through holes 124 (see FIG. 1). The second auxiliary spiral stirrup 162 penetrates, overlaps and intersects the portion of the main spiral stirrup 15 located between the second through holes 124 and the third through holes 116 (see FIG. 4). The third auxiliary spiral stirrup 163 penetrates, overlaps and intersects the portion of the main spiral stirrup 15 located between the third through holes 116 and the fourth through holes 134 (see FIG. 3). The fourth auxiliary spiral stirrup 164 penetrates, overlaps and intersects the portion of the main spiral stirrup 15 located between the fourth through holes 134 and the first through holes 114 (see FIG. 2).

Figure 5A:
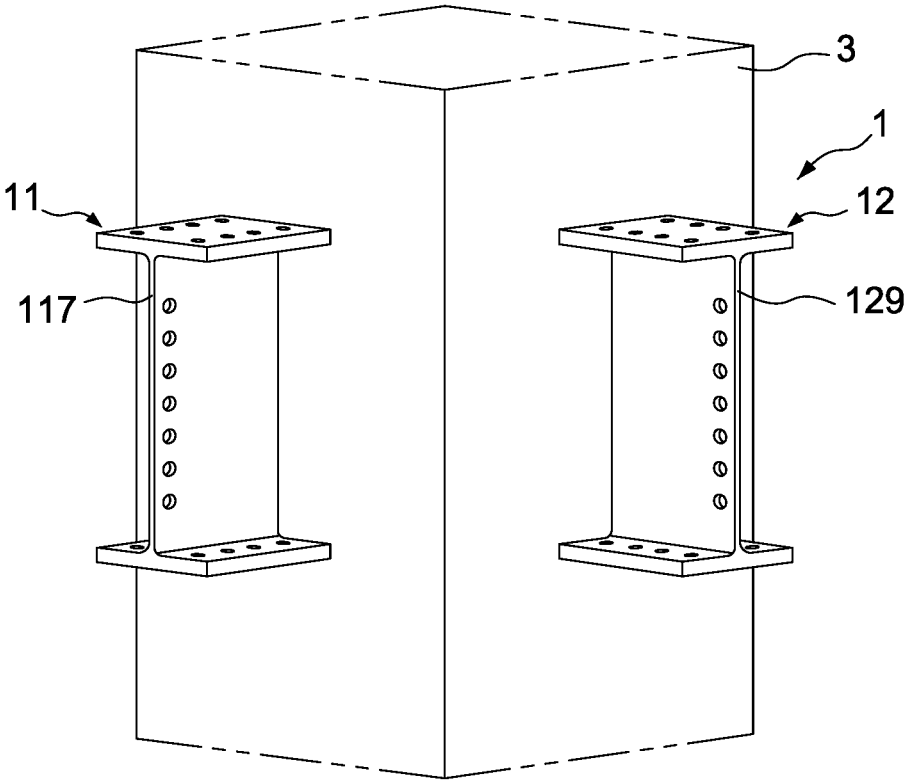
FIGS. 5A, 5B, 5C and 5D are schematic views showing the process of connecting the beam to the beam-column connection structure in accordance with an embodiment of the instant disclosure.
Figure 5B:
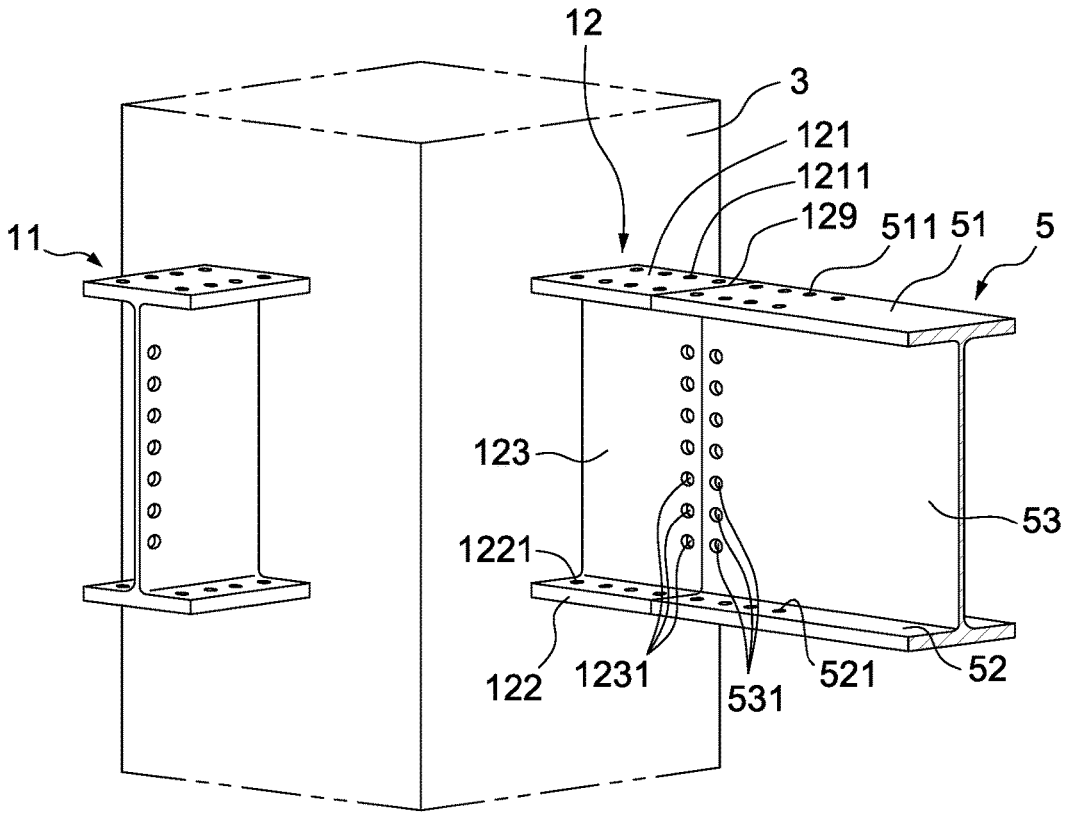
Figure 5C:
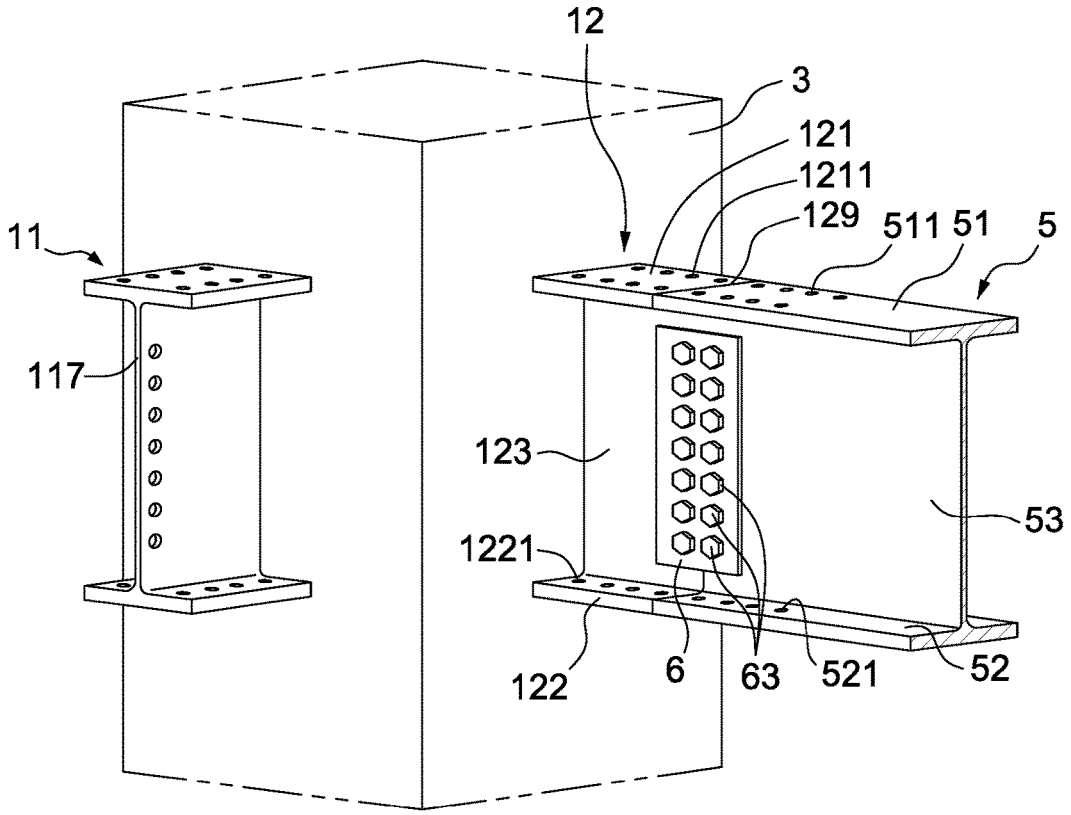
Figure 5D:
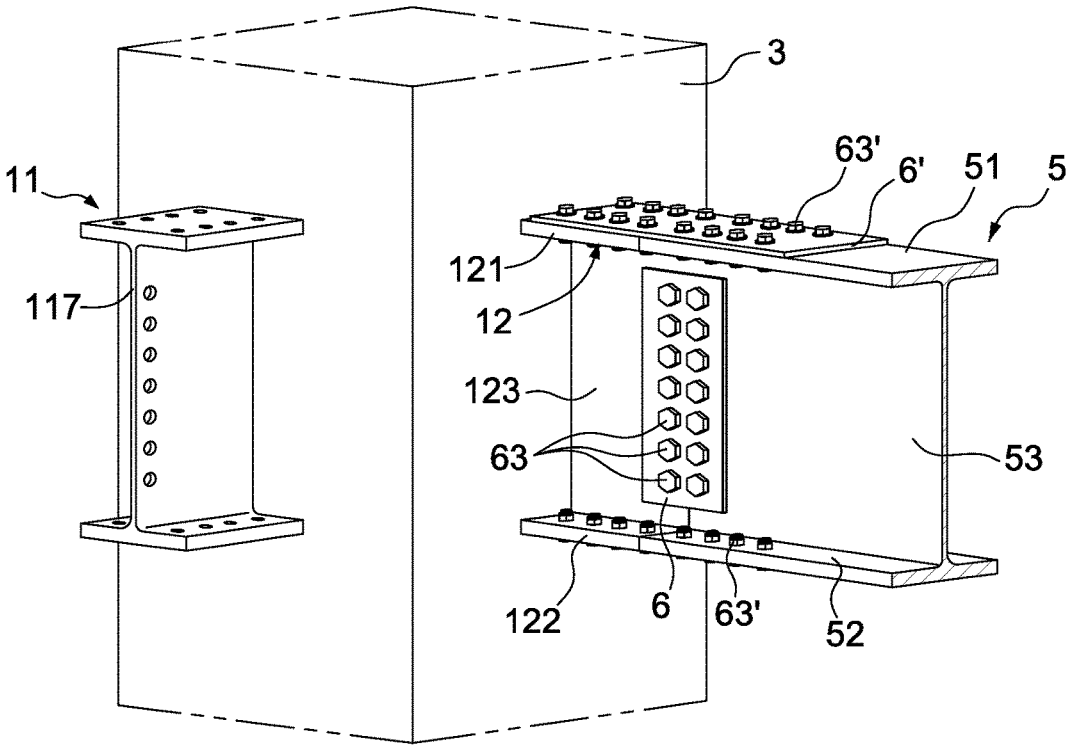

FIGS. 5A, 5B, 5C and 5D are schematic views showing the process of connecting a beam 5 to the beam-column connection 1 after a concrete structure in a rectangular shape is formed to encapsulate the stirrups 15, 161, 162, 163, 164 of the beam-column connection 1. After the beam-column connection 1 is formed, concrete is poured within concrete forms (not shown) surrounding the beam-column connection 1, and then the beam-column connection 1 is embedded in the RC column 3 after removing the concrete forms. The first end 117 and the second end 119 of the first H-shaped beam 11, the second end 129 of the second H-shaped beam 12 and the second end 139 of the third H-shaped beam protrude from the RC column 3. As shown in FIG. 5A, the second end 129 of the second H-shaped beam 12 and the first end 117 of the first H-shaped beam 11 protrude from the RC column 3. As shown in FIG. 5B, when the steel beam 5 is connected to the second end 129 of the second H-shaped steel beam 12 of the beam-column connection 1, one end of the steel beam 5 abuts against the second end 129 of the second H-shaped steel beam 12 of the beam-column connection 1. The steel beam 5 has a plurality of connecting holes 531 at one end of the web plate 53 and these connecting holes 531 are located to correspond to the third connecting holes 1231 of the second end 129 of the second H-shaped steel beam 12. Further, the top flange 51 of the steel beam 5 substantially aligns with the top flange 121 of the second H-shaped steel beam 12 and the bottom flange 52 of the steel beam 5 substantially aligns with the bottom flange 122 of the second H-shaped beam 12. As shown in FIG. 5C, a plate 6 is attached to the web plate 123 of the second H-shaped steel beam 112 and the web plate 53 of the steel beam 5 and the holes in the plate 6 (not shown) correspond to the third connecting holes 1231 of the second H-shaped steel beam 12 and the connecting holes 531 of the steel beam 5. Then, fixing bolts 63 are screwed into the holes of the plate 6, the third connecting holes 1231 of the second H-shaped steel beam 112 and the connecting holes 531 of the steel beam 5 such that the plate 6 could be fixed to the web plate 123 of the second H-shaped steel beam 12 and the web plate 53 of the steel beam 5 simultaneously. That is, the second H-shaped steel beam 12 of the beam-column connection 1 and the steel beam 5 are connected to each other through the plate 6. Moreover, as shown in FIGS. 5C and 5D, the top flange 121 and the bottom flange 122 of the second H-shaped beam 12 further comprise the connecting holes 1211, 1221 and the top flange 51 and the bottom flange 52 of the steel beam 5 further comprise the connecting holes 511, 521. The plate 6' with holes could be further attached to the top flange 121 of the second H-shaped steel beam 12 and the top flange 51 of the steel beam 5, and another plate with holes (not shown) could be further attached to the bottom flange 122 of the second H-shaped steel beam 12 and the bottom flange 52 of the steel beam 5. The holes of the plate 6' attached to the top flange 121 of the second H-shaped steel beam 12 and the top flange 51 of the steel beam 5 respectively correspond to the connecting holes 1211 on the top flange 121 on the second H-shaped steel beam 12 and the connecting holes 511 on the top flange 51 of the steel beam 5, and the holes of the plate attached to the bottom flange 122 of the second H-shaped steel beam 12 and the bottom flange 52 of the steel beam 5 respectively correspond to the connecting holes 1221 on the bottom flange 122 of the second H-shaped steel beam 12 and the connecting holes 521 on the bottom flange 52 of the steel beam 5. Then, the fixing bolts 63' are screwed into the holes of the plates 6' and the connecting holes 1211 on the top flange 121 on the second H-shaped steel beam 12 and the connecting holes 511 on the top flange 51 of the steel beam 5 and the connecting holes 1221 on the bottom flange 122 of the second H-shaped steel beam 12 and the connecting holes 521 on the bottom flange 52 of the steel beam 5 such that the connection of the steel beam 5 and the second H-shaped beam 12 could be enhanced.

Figure 6:
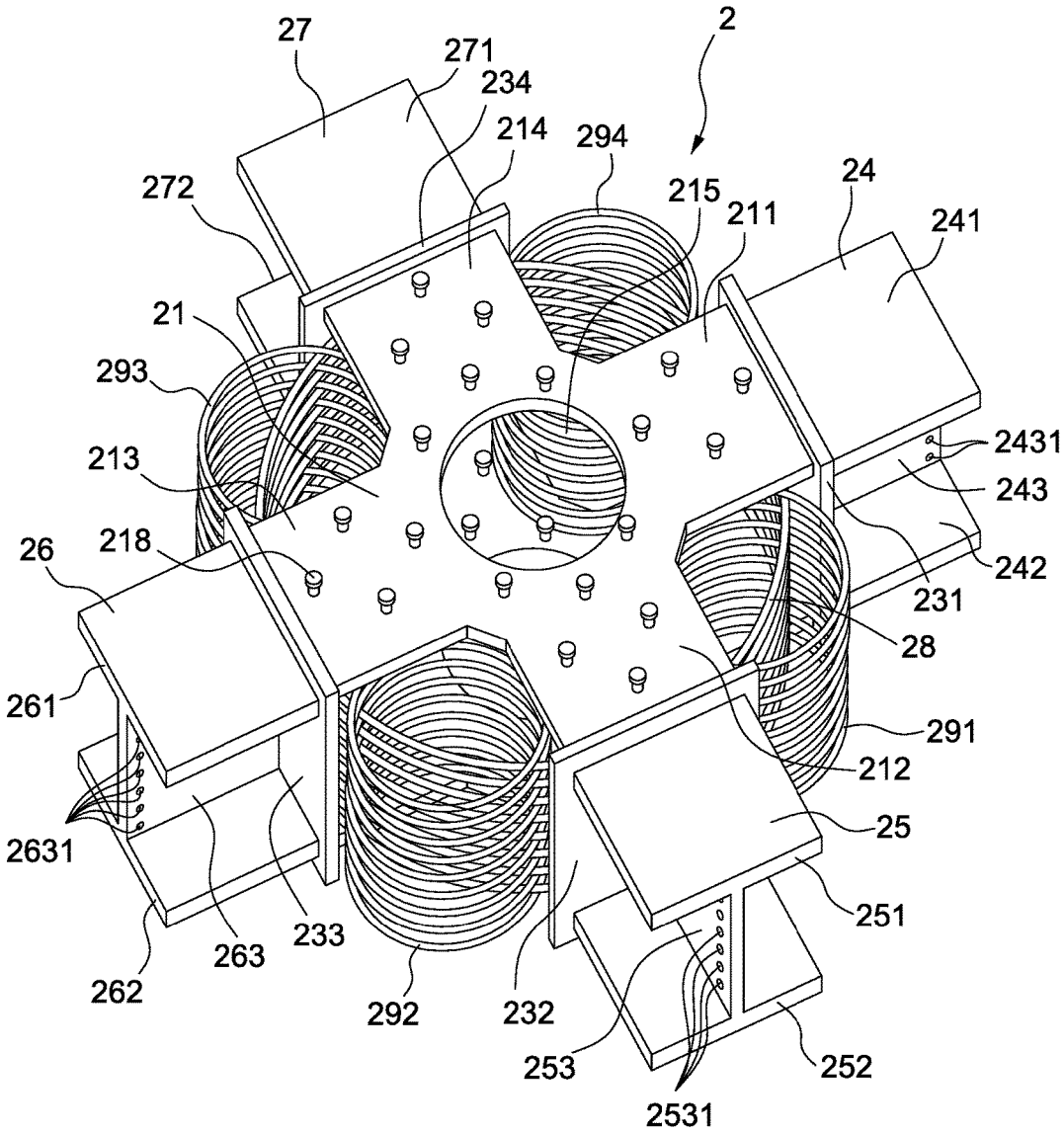
FIG. 6 is a perspective schematic view showing a beam-column connection structure in accordance with another embodiment of the instant disclosure.
Figure 7:
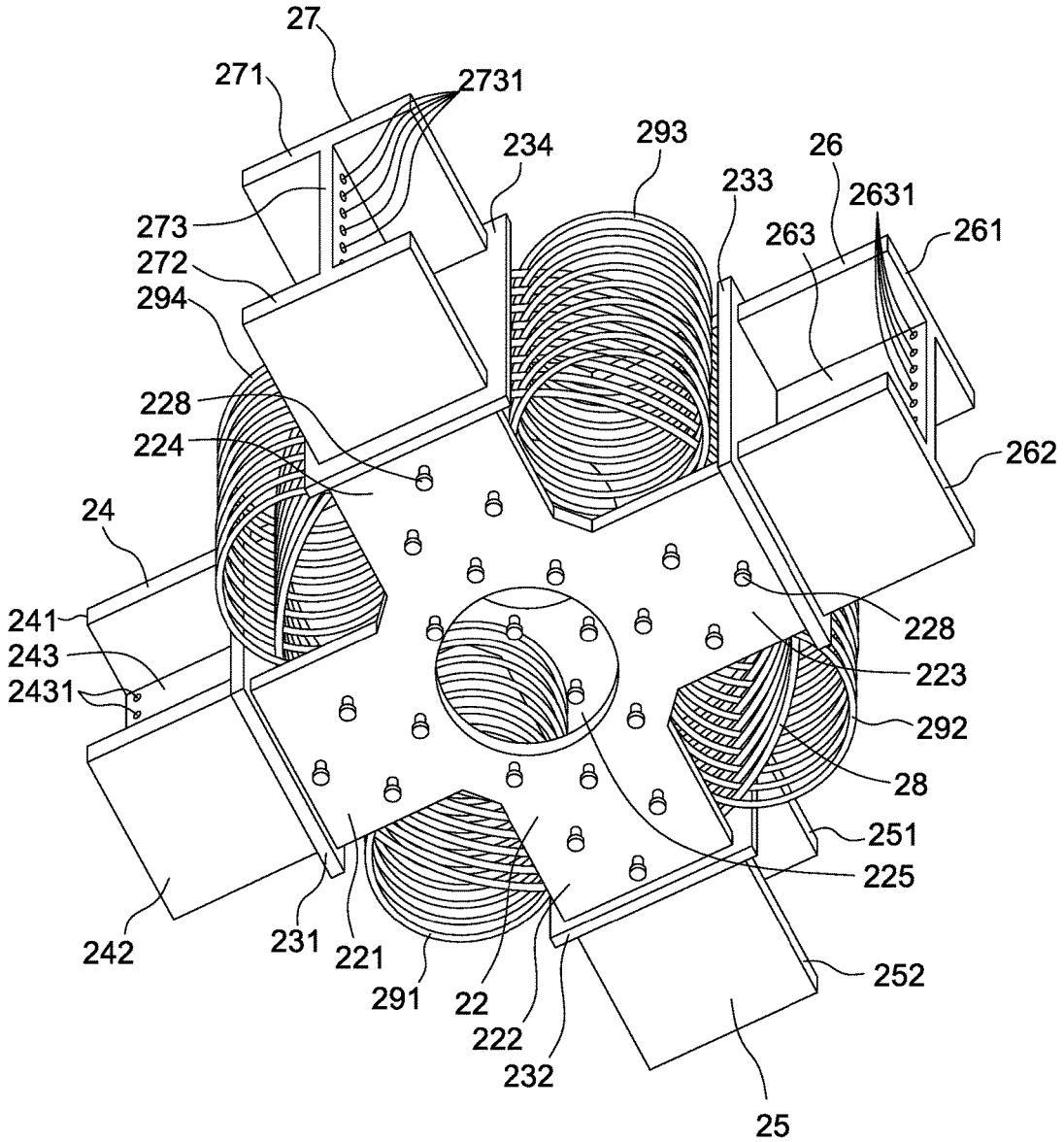
FIG. 7 is another perspective schematic view showing a beam-column connection structure in accordance with said another embodiment of the instant disclosure.

FIGS. 6 and 7 are two perspective schematic views showing a beam-column connection structure in accordance with an embodiment of the instant disclosure. As shown in FIGS. 6 and 7, the beam-column connection structure 2 comprises a first metal plate 21, which is substantially cross-shaped and has a first section 211, a second section 212, a third section 213 and a fourth section 214. Further, the first metal plate 21 has a first hole 215 located at the center of the first metal plate 21 and between these sections 211, 212, 213 and 214. The distance between the first section 211 and the first hole 215, the distance between the second section 212 and the first hole 215, the distance between the third section 213 and the first hole 215 and the distance between the fourth section 214 and the first hole 215 are substantially the same. That is, the first metal plate 21 is cross-shaped with four arms of the same length. Further, as shown FIG. 7, the beam-column connection structure 2 comprises a second metal plate 22 opposite to the first metal plate 21. The second metal plate 22 is substantially cross-shaped and has a first section 221, a second section 222, a third section 223 and a fourth section 224. Further, the second metal plate 22 has a second hole 225 located at the center of the second metal plate 22 and between these sections 221, 222, 223 and 224. The distance between the first section 221 and the second hole 225, the distance between the second section 222 and the second hole 225, the distance between the third section 223 and the second hole 225 and the distance between the fourth section 224 and the second hole 225 are substantially the same. Thus, the second metal plate 22 is cross-shaped with four arms that are of the same length. In addition, a plurality of shear studs 218 are disposed at the upper surface of the first metal plate 21 and a plurality of shear studs 228 are disposed at the upper surface of the second metal plate 22 as well.

Moreover, the beam-column connection structure 2 further comprises a first end plate 231, a second end plate 232, a third end plate 233 and a fourth end plate 234. These end plates 231, 232, 233, 234 are respectively connected to the ends of the first metal plate 21 and the ends of the second metal plate 22. The first end plate 231 is connected to the first end 211 of the first metal plate 21 and the first end 221 of the second metal plate 22. The second end plate 232 is connected to the second end 212 of the first metal plate 21 and the second end 222 of the second metal plate 22. The third end plate 233 is connected to the third end 213 of the first metal plate 21 and the third end 223 of the second metal plate 22. The fourth end plate 234 is connected to the fourth end 214 of the first metal plate 21 and the fourth end 222 of the second metal plate 22. The first metal plate 21 and the second metal plate 22 are parallel to and spaced apart from each other.

Further, a main spiral stirrup 28 is disposed within a space between the first metal plate 21 and the second metal plate 22, wherein the diameter of the main spiral stirrup 28 is substantially equal to the distance between the first end plate 231 and the third end plate 233 or the distance between the second end plate 232 and the fourth end plate 234. In addition, a first auxiliary spiral stirrup 291, a second auxiliary spiral stirrup 292, a third auxiliary spiral stirrup 293 and a fourth auxiliary spiral stirrup 294 respectively and partially intersect the main spiral stirrup 28. The first auxiliary spiral stirrup 291 is substantially located between the first sections 211, 221 of the first and second metal plates 21, 22 and the second sections 212, 222 of the first and second metal plates 21, 22 and overlaps and intersects the main spiral stirrup 28. The second auxiliary spiral stirrup 292 is substantially located between the second sections 212, 222 of the first and second metal plates 21, 22 and the third sections 213, 223 of the first and second metal plates 21, 22 and overlaps and intersects the main spiral stirrup 28. The third auxiliary spiral stirrup 293 is substantially located between the third sections 213, 223 of the first and second metal plates 21, 22 and the fourth sections 214, 224 of the first and second metal plates 21, 22 and overlaps and intersects the main spiral stirrup 28. The fourth auxiliary spiral stirrup 294 is substantially located between the fourth sections 214, 224 of the first and second metal plates 21, 22 and the first sections 211, 221 of the first and second metal plates 21, 22 and overlaps and intersects the main spiral stirrup 28.

Moreover, the beam-column connection structure 2 comprises a first H-shaped steel beam 24, a second H-shaped steel beam 25, a third H-shaped steel beam 26 and a fourth H-shaped steel beam 27, wherein the first H-shaped steel beam 24 is connected to the first end plate 231, the second H-shaped steel beam 25 is connected to the second end plate 232, the third H-shaped steel beam 26 is connected to the third end plate 233 and the fourth H-shaped steel beam 27 is connected to the fourth end plate 234, and wherein the lengths of the first, second, third and fourth H-shaped steel beams, 24, 25, 26, 27 are substantially the same.

The first H-shaped steel beam 24 comprises a top flange 241, a bottom flange 242 which is substantially parallel to the top flange 241 and a web plate 243 substantially perpendicularly connected to the top flange 241 and the bottom flange 242. One end of the first H-shaped steel beam 24 is connected to the first end plate 231 and the top flange 241 and the bottom flange 242 of the first H-shaped steel beam 24 are substantially parallel to the first metal plate 21 and the second metal plate 22 respectively. The first H-shaped steel beam 24 has a plurality of first connecting holes 2431 disposed on the web plate 243 and adjacent to the other end of the first H-shaped steel beam 24.

The second H-shaped steel beam 25 comprises a top flange 251, a bottom flange 252 which is substantially parallel to the top flange 251 and a web plate 253 substantially perpendicularly connected to the top flange 251 and the bottom flange 252. One end of the second H-shaped steel beam 25 is connected to the second end plate 232 and the top flange 251 and the bottom flange 252 of the second H-shaped steel beam 25 are substantially parallel to the first metal plate 21 and the second metal plate 22 respectively. The second H-shaped steel beam 25 has a plurality of second connecting holes 2531 disposed on the web plate 253 and adjacent to the other end of the second H-shaped steel beam 25.

The third H-shaped steel beam 26 comprises a top flange 261, a bottom flange 262 which is substantially parallel to the top flange 261 and a web plate 263 substantially perpendicularly connected to the top flange 261 and the bottom flange 262. One end of the third H-shaped steel beam 26 is connected to the third end plate 233 and the top flange 261 and the bottom flange 262 of the third H-shaped steel beam 24 are substantially parallel to the first metal plate 21 and the second metal plate 22 respectively. The third H-shaped steel beam 26 has a plurality of third connecting holes 2631 disposed on the web plate 263 and adjacent to the other end of the third H-shaped steel beam 26.

The fourth H-shaped steel beam 27 comprises a top flange 271, a bottom flange 272 which is substantially parallel to the top flange 271 and a web plate 273 substantially perpendicularly connected to the top flange 271 and the bottom flange 272. One end of the fourth H-shaped steel beam 27 is connected to the fourth end plate 234 and the top flange 271 and the bottom flange 272 of the fourth H-shaped steel beam 27 are substantially parallel to the first metal plate 21 and the second metal plate 22 respectively. The fourth H-shaped steel beam 27 has a plurality of fourth connecting holes 2731 disposed on the web plate 273 and adjacent to the other end of the fourth H-shaped steel beam 27.

Figure 8A:
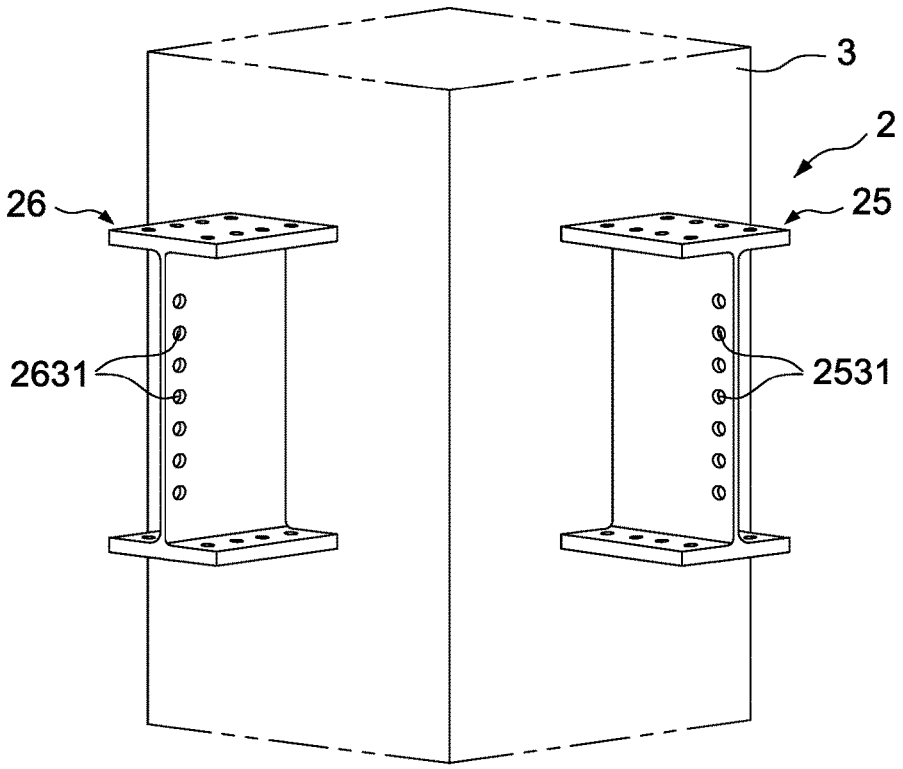
FIGS. 8A, 8B, 8C and 8D are schematic views showing the process of connecting the beam to the beam-column connection structure in accordance with a further embodiment of the instant disclosure.
Figure 8B:
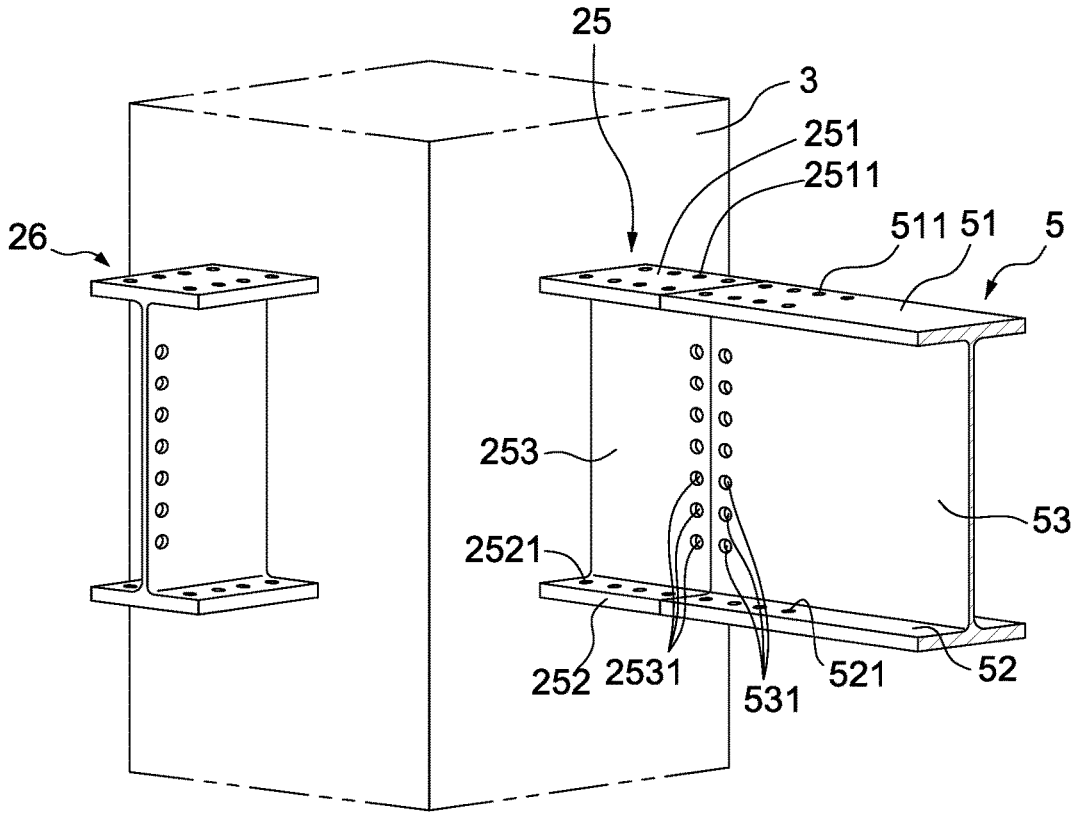
Figure 8C:
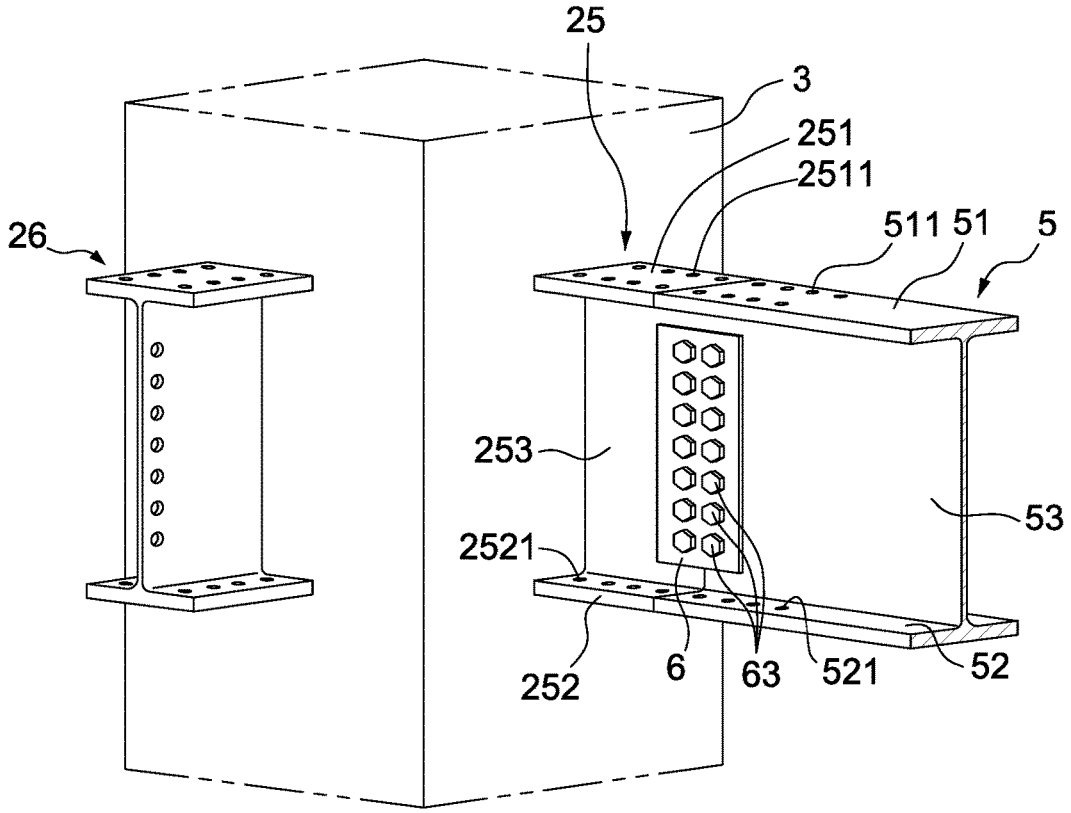
Figure 8D:
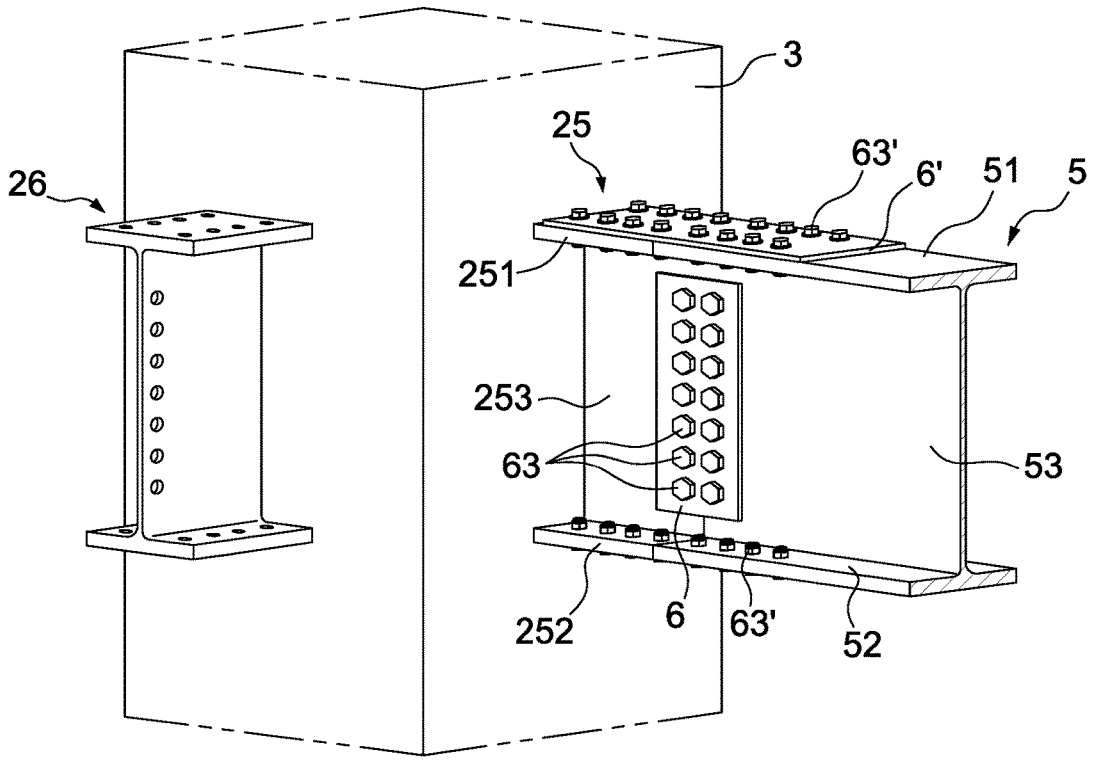

FIGS. 8A, 8B, 8C and 8D are schematic views showing the process of connecting a beam 5 to the beam-column connection structure 2 after a concrete structure in a rectangular shape is formed to encapsulate the stirrups 28, 291, 292, 293, 294 of the beam-column connection structure 2. After the beam-column connection structure 2 is formed, concrete is poured within the concrete forms (not shown) surrounding the beam-column connection structure 2, and then the beam-column connection structure 2 is embedded in the RC column 3 after the concrete forms are removed. The end of the first H-shaped steel beam 24 with the first connecting holes 2431, the end of the second H-shaped steel beam 25 with the second connecting holes 2531, the end of the third of the third H-shaped steel beam 26 with the third connecting holes 2631 and the end of the fourth H-shaped steel beam 27 with the fourth connecting holes 2731 protrude from the RC column 3. As shown in FIG. 8A, the end of the second H-shaped steel beam 25 with the second connecting holes 2531 and the end of the third of the third H-shaped steel beam 26 with the third connecting holes 2631 and the end of the fourth H-shaped steel beam 27 protrude from the RC column 3. As shown in FIG. 8B, when the steel beam 5 is connected to the second H-shaped steel beam 25 of the beam-column connection 2, one end of the steel beam 5 is arranged to align with the corresponding end of the second H-shaped steel beam 25 of the beam-column connection structure 2. The steel beam 5 has a plurality connecting holes 531 at one end of the web plate 53 and these connecting holes 531 are positioned to correspond to the second connecting holes 2531 of the second H-shaped steel beam 25. Further, the top flange 51 of the steel beam 5 substantially aligns with the top flange 251 of the second H-shaped steel beam 25 and the bottom flange 52 of the steel beam 5 substantially aligns with the bottom flange 252 of the second H-shaped beam 25. As shown in FIG. 8C, a plate 6 is attached to the web plate 253 of the second H-shaped steel beam 25 and the web plate 53 of the steel beam 5 and the holes of the plate 6 (not shown) correspond to the second connecting holes 2531 of the second H-shaped steel beam 25 and the connecting holes 531 of the steel beam 5. Then, the fixing bolts 63 are screwed into the holes of the plate 6, the second connecting holes 2531 of the second H-shaped steel beam 25 and the connecting holes 531 of the steel beam 5 such that the plate 6 could be fixed to the web plate 253 of the second H-shaped steel beam 25 and the web plate 53 of the steel beam 5 simultaneously. That is, the second H-shaped steel beam 25 of the beam-column connection 2 and the steel beam 5 are connected to each other through the plate 6. Moreover, as shown in FIGS. 8C and 8D, the top flange 251 and the bottom flange 252 of the second H-shaped beam 25 further comprise the connecting holes 2511, 2521 and the top flange 51 and the bottom flange 52 of the steel beam 5 further comprise the connecting holes 511, 521. A plate 6' with holes could be further attached to the top flange 251 of the second H-shaped steel beam 51 and the top flange 51 of the steel beam 5, and another plate with holes (not shown) could be further attached to the bottom flange 252 of the second H-shaped steel beam 25 and the bottom flange 52 of the steel beam 5. The holes of the plate 6' attached to the top flange 251 of the second H-shaped steel beam 25 and the top flange 51 of the steel beam 5 respectively correspond to the connecting holes 2511 on the top flange 251 on the second H-shaped steel beam 25 and the connecting holes 511 on the top flange 51 of the steel beam 5, and the holes of the plate attached to the bottom flange 252 of the second H-shaped steel beam 25 and the bottom flange 52 of the steel beam 5 respectively correspond to the connecting holes 2521 on the bottom flange 252 of the second H-shaped steel beam 25 and the connecting holes 521 on the bottom flange 52 of the steel beam 5. Then, the fixing bolts 63' are screwed into the holes of the plates and the connecting holes 2511 on the top flange 251 on the second H-shaped steel beam 25 and the connecting holes 511 on the top flange 51 of the steel beam 5 and the connecting holes 2521 on the bottom flange 252 of the second H-shaped steel beam 25 and the connecting holes 521 on the bottom flange 52 of the steel beam 5 such that the connection of the steel beam 5 and the second H-shaped beam 25 could be enhanced.

The above embodiments merely describe the principle and effects of the present disclosure, instead of limiting the present disclosure. Therefore, persons skilled in the art can make modifications to and variations of the above embodiments without departing from the spirit of the present disclosure. The scope of the present disclosure should be defined by the appended claims.

What is claimed is:

1. A beam-column connection structure, comprising:

a first H-shaped steel beam comprising a top flange, a bottom flange which is substantially parallel to the top flange and a web plate substantially perpendicularly connected to the top flange and the bottom flange;

a second H-shaped steel beam comprising a top flange, a bottom flange which is substantially parallel to the top flange and a web plate substantially perpendicularly connected to the top flange and the bottom flange, wherein a first end of the second H-shaped steel beam is substantially perpendicularly connected to a side of the first H-shaped steel beam;

a third H-shaped steel beam comprising a top flange, a bottom flange which is substantially parallel to the top flange and a web plate substantially perpendicularly connected to the top flange and the bottom flange; and a main spiral stirrup;

wherein a first end of the third H-shaped steel beam is substantially perpendicularly connected to the other side of the first H-shaped steel beam, and the third H-shaped steel beam substantially aligns with the second H-shaped steel beam;

wherein the web plate of the first H-shaped steel beam has a plurality of first through holes therein disposed along a direction perpendicular to a lengthwise direction of the first H-shaped steel beam;

wherein the web plate of the second H-shaped steel beam has a plurality of second through holes therein disposed along a direction perpendicular to a lengthwise direction of the second H-shaped steel beam;

wherein the web plate of the first H-shaped steel beam has a plurality of third through holes therein disposed along the direction perpendicular to the lengthwise direction of the first H-shaped steel beam, wherein the third through holes are disposed opposite to the first through holes in relation to the second and third H-shaped steel beams;

wherein the web plate of the third H-shaped steel beam has a plurality of fourth through holes therein disposed along a direction perpendicular to a lengthwise direction of the third H-shaped steel beam; and wherein the main spiral stirrup is penetrated through the first, second, third and fourth through holes and is connected with the first, second and third H-shaped steel beams.

2. The beam-column connection structure according to claim 1, further comprising:

a first auxiliary spiral stirrup configured to overlap and intersect a portion of the main spiral stirrup, the first auxiliary spiral stirrup being located between the first through holes and the second through holes;

a second auxiliary spiral stirrup configured to overlap and intersect a portion of the main spiral stirrup, the second auxiliary spiral stirrup being located between the second through holes and the third through holes;

a third auxiliary spiral stirrup configured to overlap and intersect a portion of the main spiral stirrup, the third auxiliary spiral stirrup being located between the third through holes and the fourth through holes; and a fourth auxiliary spiral stirrup configured to overlap and intersect a portion of the main spiral stirrup, the fourth auxiliary spiral stirrup being located between the fourth through holes and the first through holes.

3. The beam-column connection structure according to claim 2, wherein a plurality of first connecting holes are disposed on the web plate of the first H-shaped steel beam and adjacent to an edge of a first end of the first H-shaped steel beam, and wherein a plurality of second connecting holes are disposed on the web plate of the first H-shaped steel beam and adjacent to an edge of a second end of the first H-shaped steel beam, which is opposite to the first end of the first H-shaped steel beam, and wherein a plurality of the third connecting holes are disposed on the web plate of the second H-shaped steel beam and adjacent to an edge of a second end of the second H-shaped steel beam, which is opposite to the first end of the second H-shaped steel beam, and wherein a plurality of fourth connecting holes are disposed on the web plate of the third H-shaped steel beam and adjacent to an edge of a second end of the third H-shaped steel beam, which is opposite to the first end of the third H-shaped steel beam.

4. The beam-column connection structure according to claim 3, further comprising a plurality of shear studs disposed at the top flange of the first H-shaped steel beam, the top flange of the second H-shaped steel beam and the top flange of the third H-shaped steel beam.

5. The beam-column connection structure according to claim 3, wherein a length of the second H-shaped steel beam is substantially equal to a length of the third H-shaped steel beam.

6. The beam-column connection structure according to claim 5, wherein the distance between the first end of the first H-shaped steel beam and the joint of the first H-shaped steel beam, the second H-shaped steel beam and the third H-shaped steel beam is substantially equal to the distance between the second end of the first H-shaped steel beam and the joint and is also substantially equal to the length of the second H-shaped steel beam or the length of the third H-shaped steel beam.

7. The beam-column connection structure according to claim 6, wherein the distance between the plurality of the first through holes and the joint, the distance between the plurality of the second through holes and the joint, the distance between the plurality of the third through holes and the joint and the distance between the plurality of the fourth through holes and the joint are substantially the same.

8. The beam-column connection structure according to claim 3, wherein the main spiral stirrup has a uniform pitch.

9. The beam-column connection structure according to claim 8, wherein the distance between two adjacent first through holes, the distance between two adjacent second through holes, the distance between two adjacent third through holes and the distance between two adjacent fourth through holes are substantially equal to the pitch of the main spiral stirrup.

10. A beam-column connection structure, comprising:

a first metal plate, which is substantially cross-shaped and has a first section, a second section, a third section, a fourth section and a first hole disposed between these sections;

a second metal plate, which is substantially cross-shaped and has a first section, a second section, a third section, a fourth section and a second hole disposed between these sections, wherein the second metal plate is substantially parallel to the first metal plate and is spaced apart from the first metal plate;

a first end plate connecting to the first section of the first metal plate and the first section of the second metal plate;

a second end plate connecting to the second section of the first metal plate and the second section of the second metal plate;

a third end plate connecting to the third section of the first metal plate and the third section of the second metal plate;

a fourth end plate connecting to the fourth section of the first metal plate and the fourth section of the second metal plate; and a main spiral stirrup disposed within a space between the first and second metal plates.

11. The beam-column connection structure according to claim 10, further comprising:

a first auxiliary spiral stirrup substantially disposed between the first sections of the first metal plate and the second metal plate and the second sections of the first metal plate and the second metal plate and intersecting the main spiral stirrup;

a second auxiliary spiral stirrup substantially disposed between the second sections of the first metal plate and the second metal plate and the third sections of the first metal plate and the second metal plate and intersecting the main spiral stirrup;

a third auxiliary spiral stirrup substantially disposed between the third sections of the first metal plate and the second metal plate and the fourth sections of the first metal plate and the second metal plate and intersecting the main spiral stirrup; and a fourth auxiliary spiral stirrup substantially disposed between the fourth sections of the first metal plate and the second metal plate and the first sections of the first metal plate and the second metal plate and intersecting the main spiral stirrup.

12. The beam-column connection structure according to claim 11, further comprising:

a first H-shaped steel beam comprising a top flange, a bottom flange which is substantially parallel to the top flange and a web plate substantially perpendicularly connected to the top flange and the bottom flange, wherein a first end of the first H-shaped steel beam is connected to the first end plate and the top flange and the bottom flange of the first H-shaped steel beam are substantially parallel to the first metal plate and the second metal plate respectively, and wherein the first H-shaped steel beam has a plurality of connecting holes disposed on the web plate of the first H-shaped steel beam and adjacent to a second end of the first H-shaped steel beam, which is opposite to the first end of the first H-shaped steel beam;

a second H-shaped steel beam comprising a top flange, a bottom flange which is substantially parallel to the top flange and a web plate substantially perpendicularly connected to the top flange and the bottom flange, wherein a first end of the second H-shaped steel beam is connected to the second end plate and the top flange and the bottom flange of the second H-shaped steel beam are substantially parallel to the first metal plate and the second metal plate respectively, and wherein the second H-shaped steel beam has a plurality of connecting holes disposed on the web plate of the second H-shaped steel beam and adjacent to a second end of the second H-shaped steel beam, which is opposite to the second end of the first H-shaped steel beam;

a third H-shaped steel beam comprising a top flange, a bottom flange which is substantially parallel to the top flange and a web plate substantially perpendicularly connected to the top flange and the bottom flange, wherein a first end of the third H-shaped steel beam is connected to the third end plate and the top flange and the bottom flange of the third H-shaped steel beam are substantially parallel to the first metal plate and the second metal plate respectively, and wherein the third H-shaped steel beam has a plurality of connecting holes disposed on the web plate of the third H-shaped steel beam and adjacent to a second end of the third H-shaped steel beam, which is opposite to the first end of the third H-shaped steel beam; and a fourth H-shaped steel beam comprising a top flange, a bottom flange which is substantially parallel to the top flange and a web plate substantially perpendicularly connected to the top flange and the bottom flange, wherein a first end of the fourth H-shaped steel beam is connected to the fourth end plate and the top flange and the bottom flange of the fourth H-shaped steel beam are substantially parallel to the first metal plate and the second metal plate respectively, and wherein the fourth H-shaped steel beam has a plurality of connecting holes disposed on the web plate of the fourth H-shaped steel beam and adjacent to a second end of the fourth H-shaped steel beam, which is opposite to the first end of the fourth H-shaped steel beam.

13. The beam-column connection structure according to claim 12, further comprising a plurality of shear studs disposed at the first and second metal plates.

14. The beam-column connection structure according to claim 12, wherein the length of the first H-shaped steel beam, the length of the second H-shaped steel beam, the length of the third H-shaped steel beam and the length of the fourth H-shaped steel beam are substantially the same.

15. The beam-column connection structure according to claim 12, wherein the lengths of the first, second, third and fourth sections of the first metal plate are generally the same and the lengths of the first, second, third and fourth sections of the second metal plate are generally the same.

16. The beam-column connection structure according to claim 15, wherein the diameter of the main spiral stirrup is substantially equal to the distance between the first end plate and the third end plate or the distance between the second end plate and the fourth end plate.

* * * * *